United States Patent [19]

Rosier

[11] Patent Number: 4,896,522

[45] Date of Patent: Jan. 30, 1990

[54] ROTATABLE COUPLING FOR FASTENER INSTALLATION TOOL

[75] Inventor: Hendrik E. Rosier, Kingston, N.Y.

[73] Assignee: Huck Manufacturing Company, Irvine, Calif.

[21] Appl. No.: 326,717

[22] Filed: Mar. 21, 1989

[51] Int. Cl.[4] ..... B21J 15/20

[52] U.S. Cl. ..... 72/391; 72/453.17

[58] Field of Search ..... 72/391, 453.17, 114, 72/453.19, 481; 29/243.53

[56] References Cited

U.S. PATENT DOCUMENTS

| | | | |
|---|---|---|---|
| 3,446,509 | 5/1969 | Colosimo | 72/391 |
| 3,475,945 | 11/1969 | Chirco | 72/391 |
| 3,605,478 | 9/1971 | Chirco | 72/391 |
| 4,552,010 | 11/1985 | Hein | 72/391 |
| 4,615,206 | 10/1986 | Rosier | 72/391 |
| 4,796,455 | 1/1989 | Rosier | 72/391 |
| 4,813,261 | 3/1989 | Rosier | 72/391 |

*Primary Examiner*—David Jones

*Attorney, Agent, or Firm*—Lawrence J. Shurup

[57] ABSTRACT

An adaptor coupling for providing a rotatable connection between an installation tool and an offset nose assembly for setting pin and collar type fasteners enables previously non-rotatable nose assemblies to be rotated around the end of the installation tool to enable the nose assembly to access and set difficult to reach fasteners while at the same time minimizing operator fatigue.

7 Claims, 1 Drawing Sheet

31
52
30
46

47
45
18
26
32
22
61
42
40
60
34
36
37
14
39
28
49
50
27
68
54
63
59
56
44
16
65
70
50
80
57
39
47
20
48
10
26
24
68
29
54
67
40
42
59
34
36
37
12
14

29
42
40
32
22
34
36
59
39
44
54
67
61
56
63
57
59
34
39
13
67
42

ROTATABLE COUPLING FOR FASTENER INSTALLATION TOOL

BACKGROUND OF THE INVENTION

1. Field of the Invention

This invention is concerned with tools for swaging fastener collars onto fastener pins to rigidly fasten panels or wall structures together. A coupling for adapting a non-rotatable nose assembly tool for rotatable operation can be used between a conventional offset nose assembly and a conventional installation tool to provide the nose assembly with a rotary adjustment capability.

2. Description of Prior Developments

Lockbolt fastener installation tools are typically fitted with a fastener-engaging nosepiece which is actuated by a piston driven through a double-acting hydraulic cylinder. The nosepiece commonly includes an anvil body attachable to the tool cylinder, and a collet and jaw assembly attachable to the tool piston.

During operation of the tool, an axial motion of the piston causes the anvil to react axially so as to swage a fastener collar onto a fastener pin which is axially pulled by the collet and jaw assembly. In some applications the fasteners are located behind structures that obstruct the area along the fastener pin axis. To meet requirements imposed by such obstructed access installations there have been devised various "offset" nose assemblies.

Offset nose assemblies locate the collet and jaw assembly in an offset position spaced radially away from the tool cylinder axis. The offset nose assembly can thus be extended laterally into otherwise obstructed spaces for swaging pin and collar fasteners that would otherwise be inaccessible with conventional in-line nose assemblies.

A nose assembly of the offset type is shown in U.S. Pat. No. 4,796,455. The tool and nose assembly are rigidly and non-rotatably attached so that when the tool is held in a position most comfortable for the operator, the nose assembly may not in all instances be correctly aligned for setting the fastener. The human operator may be required to assume awkward and uncomfortable positions in order to manipulate the tool to correctly access and set the fasteners. Because installation tools can weigh from 8 to 15 pounds, an operator can quickly experience muscle fatigue. This fatigue can result in lower production rates.

To overcome the deficiencies of conventional offset nose assemblies, U.S. Pat. No. 4,813,261, provides a design for a nose assembly that can be rotatably adjusted to different positions. The construction is specially designed to be rigidly attached to a tool with a threaded adaptor coupling and smooth-surfaced sleeve. Relatively close manufacturing tolerances are maintained on the interfitting surfaces between the nose assembly and the tool to prevent deflection of the nose assembly during swaging.

U.S. Pat. No. 4,813,261 requires a threaded coupling to be rigidly affixed to a drawbar that extends through a collet. The drawbar is designed to be threaded onto a piston that forms part of the installation tool. The piston and drawbar are thus rigidly coupled together to form an elongated non-rotary support system for the rotary collet. While this nose assembly functions quite well, a need exists for adapting conventional non-rotatable nose assemblies for rotation about the piston axis of an installation tool.

SUMMARY OF THE INVENTION

The present invention solves the problems outlined above by providing a rotatable adaptor mechanism for use between a conventional non-rotatable offset nose assembly and a conventional installation tool. The adaptor mechanism allows the offset nose assembly to rotate on the installation tool. A tubular sleeve is adapted for a close rotary fit in a cylindrical socket formed in the installation tool. The adaptor mechanism transmits axial force from the tool piston via an annular shaft attachable to the installation tool piston with a threaded retaining nut.

The shaft which is attachable to the tool piston has radial and axial clearances with respect to the retaining nut so that the fit of the adaptor mechanism on the installation tool is determined solely by the close tolerance fit of the adaptor sleeve in the tool socket. This arrangement enables the adaptor mechanism to have relatively large manufacturing tolerances on most of its component parts. There is no need for special tolerances on the nose assembly components or tool components. The tool socket is typically formed with close tolerances in any case and therefore provides an accurate alignment surface upon which the present invention relies for a precision fit.

In the present invention the drawbar is not rigidly fixed to the installation tool piston as in the above-referenced U.S. Pat. No. 4,813,261. Instead, the drawbar is slidably arranged within an adaptor shaft.

DESCRIPTION OF A PREFERRED EMBODIMENT OF THE INVENTION

Figure 1:
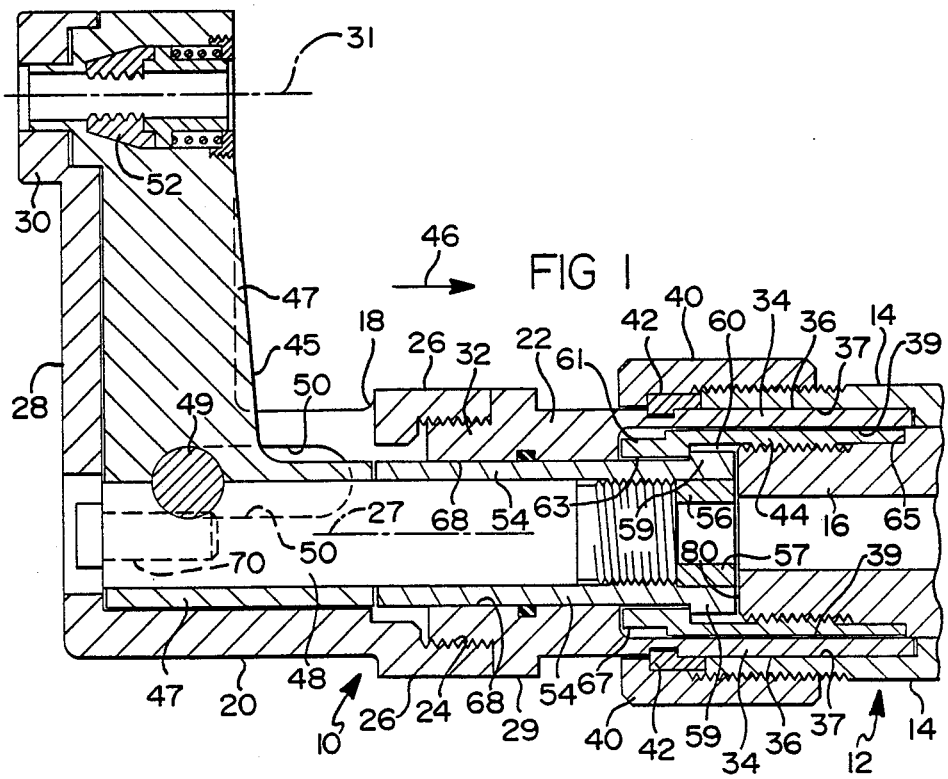
FIG. 1 is a sectional view through a tool nose assembly, and associated adaptor mechanism, arranged according to the present invention.

FIG. 1 shows a rotary offset nose assembly 10 having a jaw structure 52 and anvil section 30 for setting pin and collar type fasteners. Aforementioned U.S. Pat. No. 4,813,261, shows a pin and collar fastener construction of the type contemplated by the present invention. In the present disclosure, nose assembly 10 is shown attached to an installation tool 12 via an adaptor mechanism 13. Tool 12 includes a cylinder 14 and piston 16 slidably arranged in the cylinder.

Nose assembly 10 may be constructed in the same fashion as the corresponding nose assembly in aforementioned U.S. Pat. No. 4,796,455. Thus, the present invention may be practiced using a conventional installation tool 12 and a conventional offset nose assembly 10 such as described in U.S. Pat. No. 4,796,455.

Figure 2:
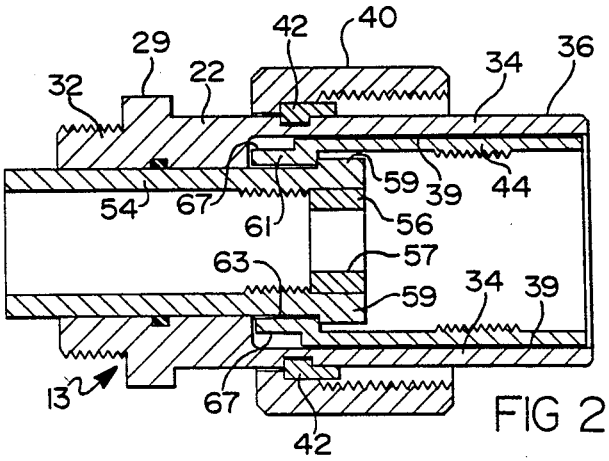
FIG. 2 is a sectional view showing the FIG. 1 adaptor mechanism separate from the tool and nose assembly.

Referring to FIG. 2, the illustrated adaptor mechanism 13 includes an adaptor element 22 of generally tubular configuration. The left end of tubular element 22 is externally threaded, as at 32, for rigid interlocking connection with internal threads 24 (FIG. 1) on the hollow L-shaped anvil body 20. The right end of tubular element 22 is formed with a sleeve 34 having a smooth cylindrical outer surface 36 adapted to rotatably fit into a cylindrical socket 37 formed in a tool cylinder 14 (FIG. 1) with a total tolerance of about 0.001 inch per diametral side. This is the only close tolerance fit required between the adaptor mechanism 13 and the tool 12.

The smooth cylindrical outer surface 36 of sleeve 34 has a rotary fit within socket 37 for rotatably supporting the anvil body 20 on tool cylinder 14. End section 33 of the element 22 includes a relatively thick hexagonal boss 29. End section 33 is formed with a smooth bore 68 designed to act as a slide bearing for tubular shaft 54. The right end of tubular shaft 54 is turned radially outwardly to form a circumferentially extending rim wall 59 for abutment with an internal retaining nut 44 which is loosely disposed within the space circumscribed by sleeve 34. The left end of internal nut 44 is turned radially inwardly to form a circumferential flange 61.

FIG. 1 shows generally how adaptor mechanism 13 is used as a rotatable interconnection between tool 12 and nose assembly 10. Anvil body 20 includes a left end wall 28 that extends generally normal to axis 27 to form the annular collar-engagement anvil section 30 centered on a parallel axis 31 that is laterally (radially) offset from axis 27.

Sleeve 34 is releasably retained in the cylindrical socket 37 by a nut 40 and split-ring assembly 42 which seats in an annular groove 26 formed in the outer surface of sleeve 34. The split ring retention system is similar to that shown in aforementioned U.S. Pat. No. 4,813,261. In the present arrangement, sleeve 34 is slightly axially shorter than the depth of cylindrical socket 37, such that the nose assembly 10 can rotate on axis 27 without excessive frictional interference from split ring 42 or the internal surface of socket 37. The inner cylindrical surface 39 of sleeve 34 has ample radial clearance with respect to the outer surface of retaining nut 44.

Nose assembly 10 further includes a pin-puller or collet member 45 slidably arranged within anvil body 20 for axial movement in the direction indicated by arrow 46. The collet includes an L shaped body 47 affixed to an elongated cylindrical drawbar 48 via a transverse pin 49 which is grooved to receive a standard fastener 70 threaded into the drawbar 48. The opposite ends of pin 49 extend into slots 50 in the side walls of anvil body 20 to prevent relative rotation between the anvil body and the collet. The collet 45 includes a conventional jaw structure 52 designed to exert a pulling force on a pin-type fastener when the collet is moved in the direction of arrow 46 by the tool piston 16.

Tubular shaft 54 is installed into adaptor element 22 with a right-to-left motion of the shaft, after first positioning nut 44 within the space circumscribed by sleeve 34. Drawbar 48 is threadably connected to the annular cylindrical shaft 54 of adaptor mechanism 13. The threading operation is facilitated by an annular insert 56 that is press fit in the end of the hollow tubular shaft 54. A hexagonal hole 57 is formed in insert 56 to receive an allen wrench for threading tubular shaft 54 onto drawbar 48.

As shown in FIG. 2, rim wall 59 and flange 61 have small axial and radial clearances therebetween. Moreover, as seen in FIG. 1, when installed on tool 12, the confronting surfaces between tubular shaft 54 and internal retaining nut 44 are provided with a clearance fit for free rotative movement therebetween. The circumferential rim wall 59 is adapted to extend with a clearance fit into an axial space 60 defined between the end of piston 16 and the inturned flange 61 formed on internal retaining nut 44. The retaining nut 44 is threaded onto piston 16 after hollow shaft 54 has been inserted through circular opening 63 in the retaining nut. Wrench flats 67 on nut 44 facilitate the threading operation onto the piston.

A shoulder 65 on the piston limits the threading motion of nut 44 onto the piston, such that when the nut has been fully threaded onto the piston there are radial and axial clearances between tubular shaft 54, retaining nut 44, and the front face 80 of piston 16. Thus, rim wall 59 has an axial dimension that is slightly less than the axial extent of space 60. Also, the diameter of opening 63 is slightly greater than the outer diameter of tubular shaft 54.

After nose assembly 10 has been installed on tool 14 via adaptor mechanism 13, hollow shaft 54 will have a sliding fit in tubular adaptor element 22. Thus, the inner cylindrical bearing surface 68 on the thickened section of adaptor element 22 will act as a slide bearing for tubular shaft 54. The tolerances between the bearing surface 68 and the tubular shaft 54 are preferably maintained within a range of about 0.0005 inch per diametral side. This is the only close fit required between the nose assembly 10 and the adaptor mechanism 13. The subassembly of the collet 45, drawbar 48 and tubular shaft 54 is capable of axial sliding motion on the cylindrical bearing surface 68. Surface 68 is relatively long in the axial direction so that it can function without excessive wear or unit stress.

As previously noted, both the anvil body 20 and collet 45 can rotate on tool 12 around rotational axis 27. The drawbar 48, although stationary with respect to the anvil body 20 and collet 45, rotates with the entire nose assembly 10. Radial and axial clearances between tubular shaft 54, retaining nut 44 and piston 16 allow free rotation between tubular shaft 54 and piston 16 and tool cylinder 14. At the same time, retaining nut 44 acts as a force-transmitting connection between piston 16 and the collet 45, whereby axial motion of the piston is translated into axial motion of the collet in the direction of arrow 46. An elastomeric O-ring 90 may be fitted between the tubular adaptor 22 and the cylindrical shaft 54 to serve as a frictional brake for holding the nose assembly in place once it has been rotated to a desired orientation.

The clearance condition provided between shaft 54, nut 44 and piston 16 is most important. The radial and axial clearances are such that shaft 54 is able to have a desirable close sliding fit on cylindrical bearing surface 68 without interfering in any way with the rotary sliding fit of sleeve 34 in socket surface 37.

The drawing shows one particular form that the invention can take. Other forms are possible.

I claim:

1. An adaptor mechanism installable between a piston driven fastener installation tool and an offset nose assembly for enabling the nose assembly to be rotatably adjustable within a socket formed in the tool, said adaptor mechanism comprising:

a tubular adaptor element having a threaded end section attachable to the nose assembly, and a smooth-surfaced sleeve section insertable into the socket in the installation tool;

a shaft having a close sliding fit within said tubular adaptor element, said shaft having internal threads for connection of the shaft to the nose assembly, and a first engagement means for connecting the shaft to the installation tool; and a retaining nut connectable to said piston and having second engagement means axially aligned with said first engagement means such that said nut acts as a force-transmitting connection between the shaft and the piston via said first and second engagement means.

2. In association with an installation tool that includes a cylinder having an end section that is internally smooth surfaced and externally threaded and a slidable piston located within said cylinder, said piston having an externally threaded section located within the space circumscribed by the cylinder end section, and an offset nose assembly that includes an anvil body having an internally threaded end section, and a slidable drawbar extending through the space circumscribed by the internally threaded end section of the anvil body, the improvement comprising:

an adaptor mechanism operatively interconnecting the installation tool and offset nose assembly so that the nose assembly is rotatably adjustable around the axis of the tool cylinder, and the drawbar is movable with the tool piston back and forth within the anvil body;

said adaptor mechanism comprising a tubular adaptor element having an externally threaded section interlockably extending into the threaded section of the anvil body, and a smooth-surfaced sleeve section slidably and rotatably fitting within the smooth-surfaced end section of the tool cylinder, such that the nose assembly is rotatably adjustable around the tool cylinder axis.

3. The improvement of claim 2 wherein said adaptor mechanism further comprises an annular shaft threadably connected to said drawbar, said annular shaft having a close slidable fit within said tubular adaptor element.

4. The improvement of claim 3 wherein said adaptor mechanism further includes a retaining nut threaded onto the externally threaded section of the tool piston, said retaining nut being movably connected to said annular shaft to act as a force-transmitting connection between the piston and the annular shaft.

5. The improvement of claim 4 wherein the retaining nut has an inwardly radiating flange and said annular shaft has an outwardly radiating rim wall, said rim wall being adapted to fit within the retaining nut between said inwardly radiating flange and the end surface of the tool piston.

6. The improvement of claim 5 wherein the axial thickness of the outwardly radiating rim wall is slightly less than the axial space defined between the retaining nut flange and the piston end surface.

7. The improvement of claim 6 wherein the radial dimension of said rim wall is slightly less than the internal radial dimension of the retaining nut.

* * * * *